US010253701B2

(12) United States Patent
Mendler

(10) Patent No.: US 10,253,701 B2
(45) Date of Patent: Apr. 9, 2019

(54) EXPANDABLE JOINT FOR VARIABLE COMPRESSION RATIO ENGINES

(71) Applicant: Edward Charles Mendler, Mill Valley, CA (US)

(72) Inventor: Edward Charles Mendler, Mill Valley, CA (US)

( * ) Notice: Subject to any disclaimer, the term of this patent is extended or adjusted under 35 U.S.C. 154(b) by 0 days.

(21) Appl. No.: 15/731,724

(22) PCT Filed: Feb. 22, 2016

(86) PCT No.: PCT/US2016/000017

§ 371 (c)(1),
(2) Date: Jul. 24, 2017

(87) PCT Pub. No.: WO2016/140729

PCT Pub. Date: Sep. 9, 2016

(65) Prior Publication Data

US 2018/0023487 A1 Jan. 25, 2018

Related U.S. Application Data

(60) Provisional application No. 62/176,649, filed on Feb. 24, 2015.

(51) Int. Cl.
*F02D 15/04* (2006.01)
*F02B 75/04* (2006.01)

(52) U.S. Cl.
CPC ..... *F02D 15/04* (2013.01); *F02B 75/041* (2013.01)

(58) Field of Classification Search
CPC .... F16C 23/10; F16C 3/28; F16C 9/00; F02D 15/00
See application file for complete search history.

(56) References Cited

U.S. PATENT DOCUMENTS 2,449,662 A * 9/1948 Leeson ..... F16C 33/06 29/898.054
3,144,702 A * 8/1964 Wuppermann ..... B23K 11/04 228/182
3,352,290 A * 11/1967 Kuroda ..... F01C 21/04 418/60
5,611,301 A 3/1997 Gillbrand
6,550,441 B1 * 4/2003 Drangel ..... F02B 75/047 123/195 R
7,036,468 B2 * 5/2006 Kamiyama ..... F02B 75/041 123/78 R (Continued)

*Primary Examiner* — Long T Tran

(57) ABSTRACT

According to the present invention an expandable joint is made without removable bearing caps by preassembling eccentric bushings onto the hinge pin. The expandable joint has a hinge type construction, but with the journals for each side of the hinge being spaced apart so that the distance between the two sides of the hinge changes with rotation of the hinge pin. The expandable joint of the present invention is assembled by sliding the hinge pin into the hinged joint with the eccentric bushings attached. Once the hinge pin is in place, the eccentric bushings are locked in place with fasteners so that they do not rotate. After the eccentric bushings are locked in place, the hinge pin can be turned to expand the joint. The expandable joint is intended for use in variable compression ratio engines, where expansion of the joint changes the compression ratio of the engine.

22 Claims, 7 Drawing Sheets

(56) References Cited

U.S. PATENT DOCUMENTS

| | | | | |
|---|---|---|---|---|
| 7,721,688 | B2 * | 5/2010 | Kamiyama | F02B 75/041 123/41.84 |
| 7,806,092 | B2 | 10/2010 | Kamiyama | |
| 8,701,606 | B2 * | 4/2014 | Tateno | F02B 75/041 123/48 C |
| 8,985,070 | B2 * | 3/2015 | Tateno | F02B 75/041 123/48 B |
| 2010/0163002 | A1 | 7/2010 | Kamiyama | |
| 2012/0279014 | A1 * | 11/2012 | Carlsson | F16C 11/045 16/273 |
| 2013/0306035 | A1 * | 11/2013 | Hiyoshi | F02B 75/047 123/48 B |
| 2014/0283786 | A1 | 9/2014 | Nakasaka | |
| 2014/0290625 | A1 * | 10/2014 | Hiyoshi | F02B 75/32 123/48 R |
| 2015/0337891 | A1 * | 11/2015 | Mano | F01D 17/162 403/144 |

* cited by examiner

EXPANDABLE JOINT FOR VARIABLE COMPRESSION RATIO ENGINES

This application relates to Provisional Application No. 62/176,649 having a filing date of Feb. 24, 2015, and Provisional Application No. 62/230,277 having a filing date of Jun. 1, 2015, and Provisional Application having a filing date of Feb. 1, 2016 and a U.S. Express Mail No. EK 886663519 U.S. with a Provisional Application No. 62/388, 596.

BACKGROUND OF THE INVENTION

Prior art variable compression ratio engines have eccentric hinge pin expandable joints. These engines have hinge pins with off-set journals bearing for adjusting engine compression ratio. The prior art engines employ removable bearing caps for assembly of the eccentric hinge pins in the engine. A problem with these engines is that they would be expensive to manufacture and expensive to assemble due to the large number of bearing caps that need to be bolted together. A second problem is low mechanical stiffness and strength. The problem of low strength and stiffness is compounded in engines where the parting line of the bearing cap is oriented vertically rather than horizontally for best supporting the high mechanical forces encountered in internal combustion engines.

Eichi Kamiyama shows in U.S. Pat. No. 7,806,092 a variable compression ratio engine having an eccentric hinge pin assembly 25*c*, 25*c*1, 25*c*2, 25*c*3 and 25*c*4 retained in crankcase bearing caps 25*a*, 25*a*2 and jug bearing caps or bearing blocks 25*b*. Crankcase bearing caps 25*a*2 are bolted to crankcase 21, and jug bearing caps or bearing blocks 25*b* are bolted to jug 23. A problem with the invention taught in U.S. Pat. No. 7,806,092 is that it is expensive to manufacture and expensive to assemble due to the large number of bearing caps that need to be bolted to the jug and crankcase. A second problem is low mechanical stiffness and strength.

Per Gillbrand shows in U.S. Pat. No. 5,611,301 a variable compression ratio engine having an eccentric hinge pin 44 and removable bearing caps 46 and links 41. These components collectively result in a relatively large, heavy and expensive engine.

SUMMARY OF THE INVENTION

According to the present invention an expandable joint is made without removable bearing caps by preassembling eccentric bushings onto the hinge pin.

The expandable joint has a hinge type construction, but with the journals for each side of the hinge being spaced apart so that the distance between the two sides of the hinge changes with rotation of the hinge pin.

The expandable joint of the present invention is assembled by sliding the hinge pin into the hinged joint with the eccentric bushings attached. Once the hinge pin is in place, the eccentric bushings are locked in place with fasteners so that they do not rotate. After the eccentric bushings are locked in place, the hinge pin can be turned to expand the joint.

The expandable joint is intended for use in variable compression ratio engines, where expansion of the joint changes the compression ratio of the engine. A major benefit of the present invention is that it is robust and can support the large forces encountered in internal combustion engines. Another benefit of the present invention is that removable bearing caps are not required, resulting in a lower cost and a smaller size than expandable joints used in prior art variable compression ratio engines.

DETAILED DESCRIPTION OF THE PREFERRED EMBODIMENTS

Figure 1:
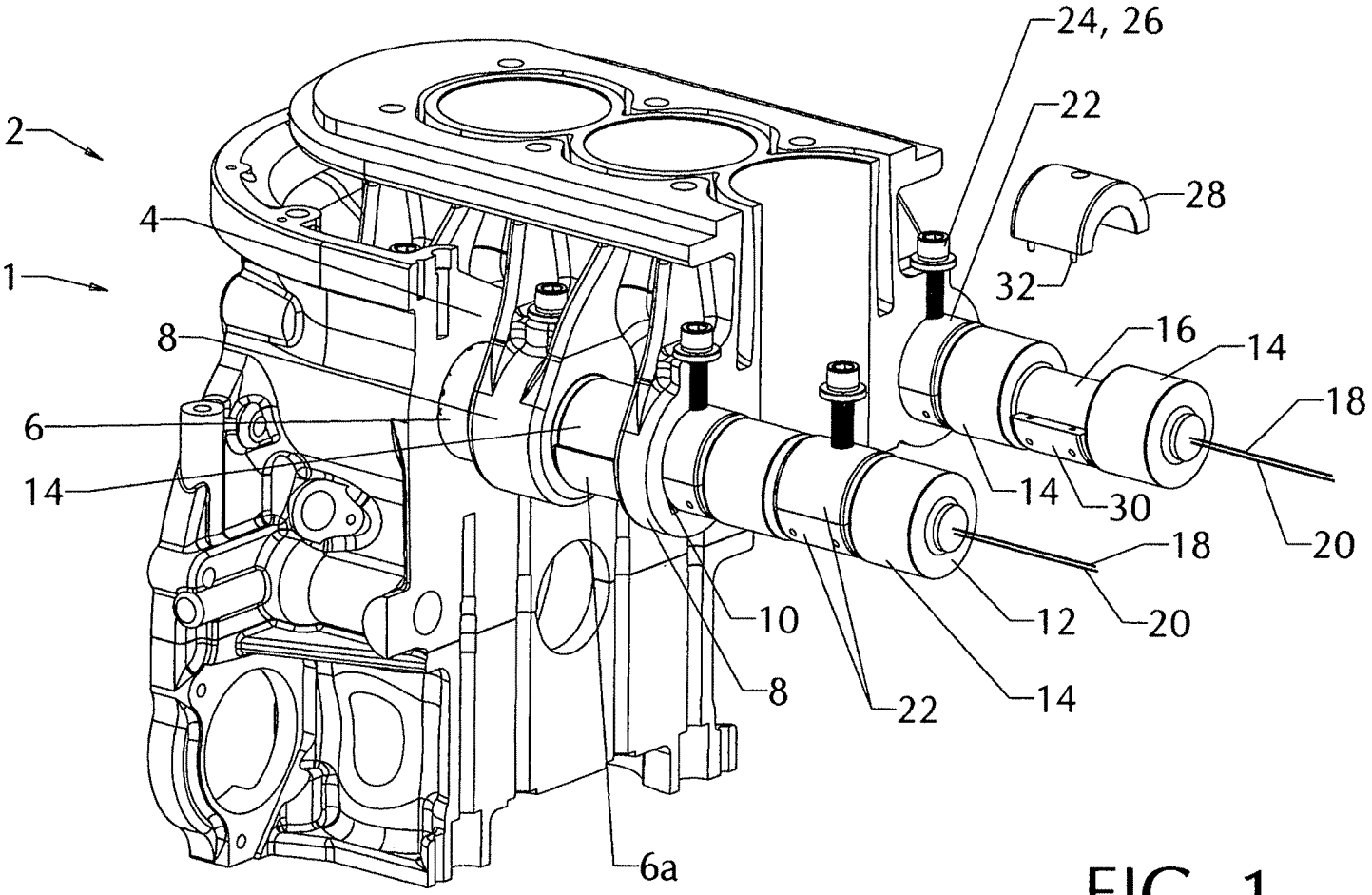
FIG. 1 is intended to schematically illustrate an expandable joint according to the present invention.
Figure 3:
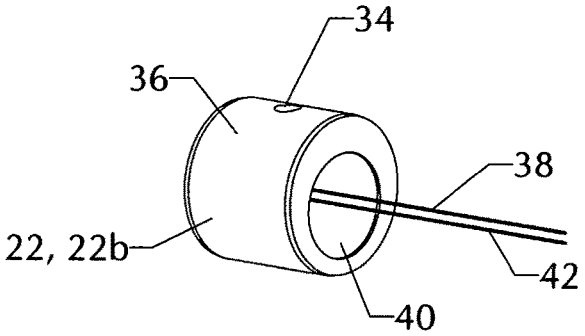
FIG. 3 shows an eccentric bushing having a contiguous metal structure according to the present invention.
Figure 4:
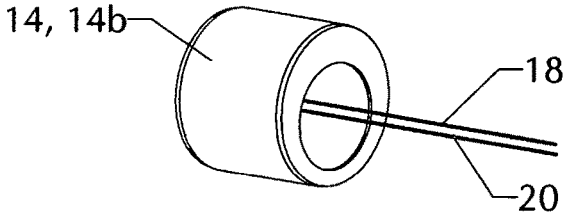
FIG. 4 shows a primary journal eccentric according to the present invention.
Figure 5:
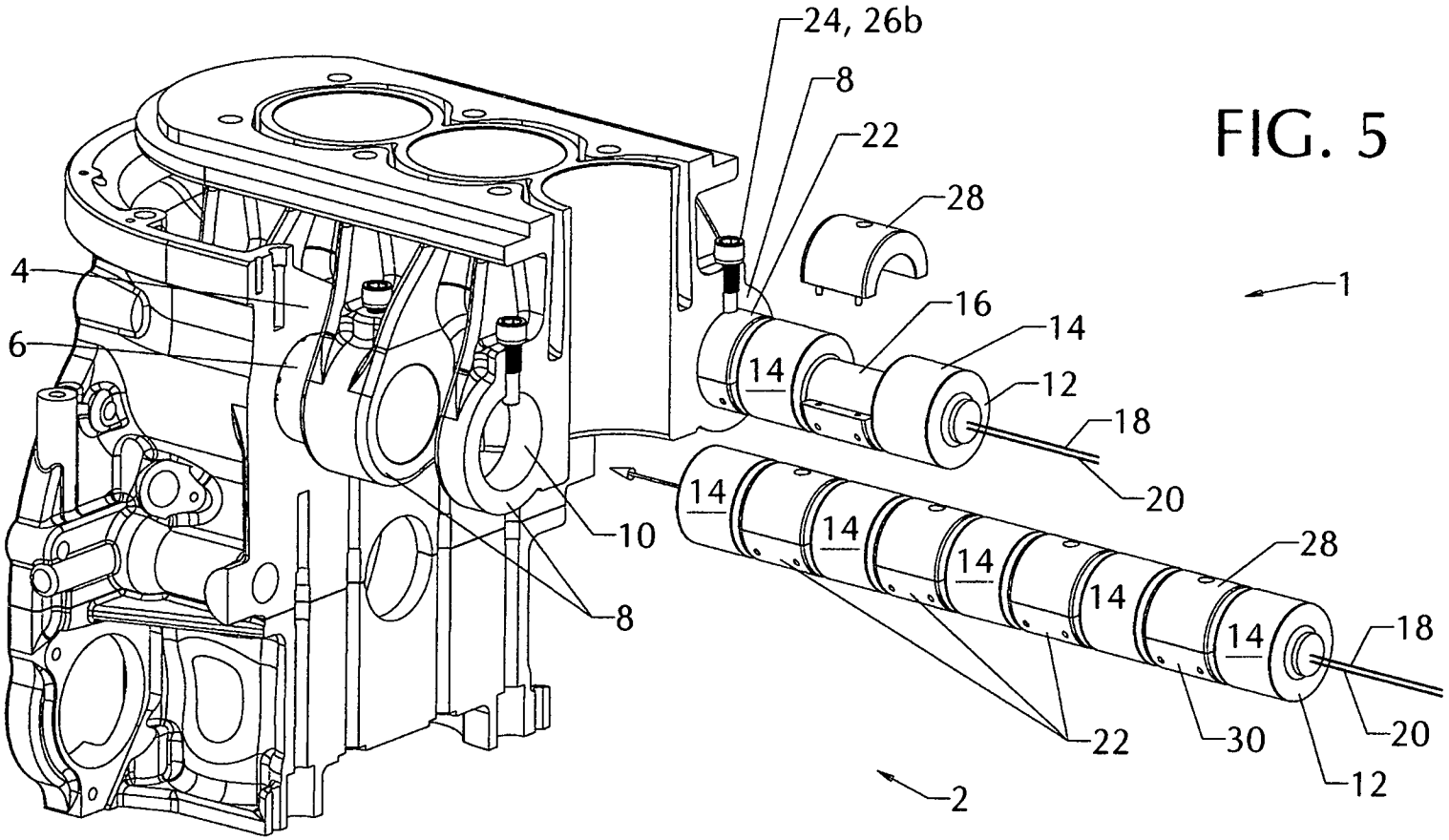
FIG. 5 is similar to FIG. 1, but shows one hinge pin not slid into the eccentric hinged joint.
Figure 6:
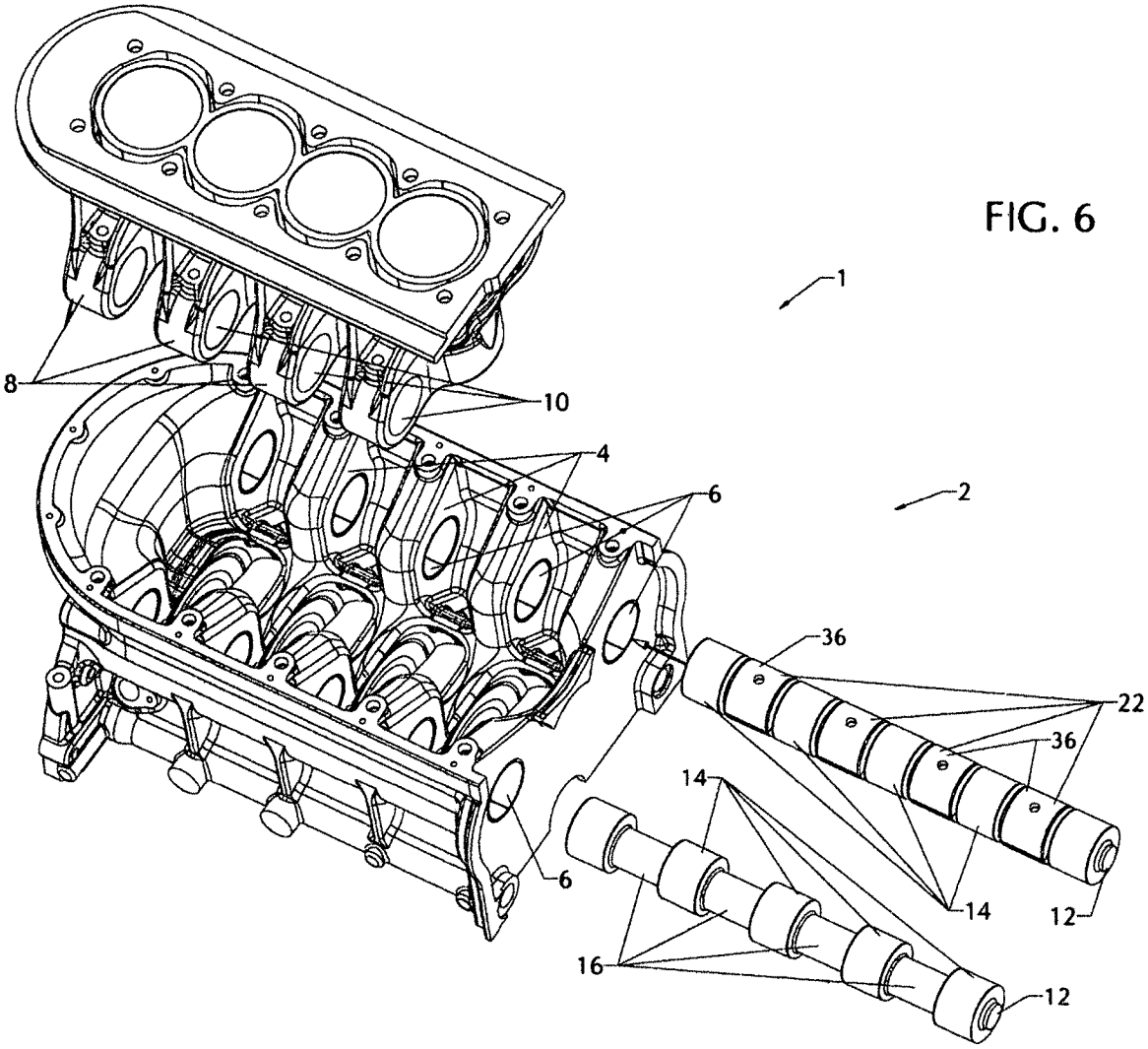
FIG. 6 is an exploded view of the present invention showing the eccentric hinged joint of the present invention unassembled.

FIGS. 1 through 6 are intended to schematically illustrate a portion of a variable compression ratio engine 1 having an expandable joint or eccentric hinged joint 2 according to the present invention. FIG. 1 provides a cutaway view of the variable compression ratio engine having the eccentric hinged joint according to the present invention. FIG. 5 is similar to FIG. 1 but one hinge pin has not yet been slid into the engine. FIG. 6 is an exploded view of the present invention that shows the hinged joint unassembled.

Eccentric hinged joint 2 has a primary or first bearing housing 4 having a plurality of primary journal bearings 6, and a second bearing housing 8 having a plurality of secondary journal sockets 10.

Eccentric hinged joint 2 has a hinge pin 12 having a plurality of primary journals 14 and a plurality of secondary journals 16. The primary journals 14 define a first journal axis 18 and the secondary journals 16 define a second journal axis 20, second journal axis 20 being offset from said first journal axis 18.

According to the preferred embodiment of the present invention, eccentric hinged joint 2 further includes one or more eccentric bushings 22. The eccentric bushings 22 are located in secondary journal sockets 10 after assembly of the eccentric hinged joint 2.

The primary journals 14 are rotatably mounted in the primary journal bearings 6, and the secondary journals 16 are rotatably mounted in the eccentric bushings 22 for providing eccentric motion of the eccentric hinged joint 2.

Referring now to FIG. 1, only a lower portion 6*a* of primary journal bearing 6 is shown in order to make visible primary journal 14.

The eccentric hinged joint 2 further includes eccentric bushing retaining means 24 for preventing movement of the eccentric bushings 22 in the secondary journal sockets 10 after assembly of the eccentric hinged joint 2. In more detail, the bushing retaining means 24 secure or fixes the offset location of the eccentric bushing 22 in the secondary journal sockets 10, and in more detail bushing retaining means 24 fixes the location of bushing minor axis 42 in second bearing housing 8. The eccentric bushing retaining means 24 may optionally be a threaded fastener 26, a compression fastener 26*b*, a pin, a key, adhesive, solder, braze, weld, an interference fit, a combination of the above or other functional means. Retaining means 24 may be located above secondary journal socket 10 as shown, or optionally below or to the side of secondary journal socket 10.

FIGS. 1 and 5 show a portion of a variable compression ratio engine 1 having two eccentric hinged joints 2 of similar construction. The two eccentric hinged joints 2 rotate in the same direction and in phase to adjust the compression ratio of variable compression ratio engine 1. A single eccentric hinged joint 2 according to the present invention may be used in other types of variable compression ratio engines.

Figure 2:
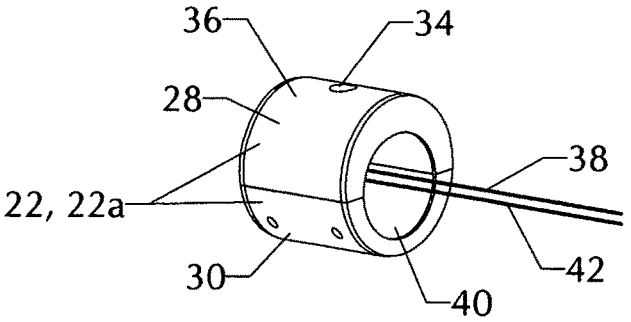
FIG. 2 shows an eccentric bushing having upper and lower halves according to the present invention.

FIGS. 1, 2 and 6 shows an eccentric bushing 22 having an upper bushing half 28 and a lower bushing half 30. A subset of eccentric bushings 22 are assembled eccentric bushings 22*a*. The bushing has separable halves to permit assembly on secondary journals 16 between two larger diameter primary journals 14. Referring now to FIGS. 1 through 6, eccentric bushing 22 has a bushing outer surface 36 that is seated in secondary journal sockets 10 located in secondary bearing housings 8. Eccentric bushing 22 optionally has a threaded hole, a pin hole, a socket, flat, keyway or other functional means 34 for receiving bushing retaining means 24. Bushing outer surface 36 defines a bushing major axis 38. Eccentric bushing 22 further has a bushing inner bearing surface 40 that bears on secondary journals 16 located on hinge pin 12. Bushing inner surface 40 defines a bushing minor axis 42, bushing minor axis 42 being offset from bushing major axis 38.

In the embodiment of the present invention shown in FIGS. 1 through 6 the diameter of bushing outer surface 36 is approximately the same as the diameter of primary journals 14. Additionally, in the embodiment of the present invention shown in FIGS. 1 through 6, the distance between bushing major axis 38 and bushing minor axis 42 is equal to or approximately equal to the distance between first journal axis 18 and second journal axis 20, thereby enabling the outer surface of primary journals 14 to be generally aligned with bushing outer surface 36, and thereby enable hinge pins 12, with eccentric bushings 22 attached, to axially slide into primary journal bearings 6 and secondary journal sockets 10, and thereby provide for assembly of eccentric hinge joint 2, and in more detail without need for removable bearing caps.

According to the present invention, eccentric hinged joint 2 has at least one eccentric bushing 22 assembled onto hinge pin 12 between two primary journals 14.

Eccentric hinge joint 2 further has a first axial assembly clearance for slidably assembling an eccentric bushing 22 on hinge pin 12 through at least one primary journal bearing 6. Eccentric hinge joint 2 further has a second axial assembly clearance for slidably assembling a primary journal 14 on hinge pin 12 through at least one secondary journal socket 10. Preferably, according to the present invention, eccentric hinge joint 2 has a first axial assembly clearance for slidably assembling an eccentric bushing 22 on hinge pin 12 through at least one primary journal bearing 6, and eccentric hinge joint 2 has a second axial assembly clearance for slidably assembling a primary journal 14 on hinge pin 12 through at least one secondary journal socket 10. In more detail, second bearing housing 8 and secondary journal socket 10 have an internal diameter and primary journal 14 has an outer primary journal diameter, where the internal diameter is larger than the outer primary journal diameter, thereby providing assembly clearance for the primary journal 14 to pass through the secondary bearing housing 8 and secondary journal socket 10 for assembly of the eccentric hinged joint 2.

Eccentric bushing 22 also has an outer bushing diameter and primary journal 14 has an outer primary journal diameter. Preferably, according to the present invention, the outer bushing diameter is within 0.007 inches of the outer primary journal diameter thereby enabling hinge pin 12 to slide into hinged joint 2.

A significant benefit of the present invention is that removable bearing caps are not required for assembling the hinge pins in the engine. Referring now to FIGS. 1, 5 and 6, eccentric hinged joint 2 preferably has at least one primary bearing housing 4 having a contiguous metal or material structure surrounding at least one primary journal bearing 6 thereby providing a rigid and compact eccentric hinged joint 2. Preferably at least one secondary bearing housing 8 has a contiguous metal or material structure surrounding at least one secondary journal socket 10 thereby providing a rigid and compact eccentric hinged joint. And preferably at least one primary bearing housing 4 has a contiguous metal or material structure surrounding at least one primary journal bearing 6, and at least one secondary bearing housing 8 has a contiguous metal or material structure surrounding at least one secondary journal socket 10 thereby providing a rigid and compact eccentric hinged joint.

According to the present invention, hinge pin 12 may be a contiguous metal shaft including at least on primary journal 14 and at least one secondary journal 16. Assembled eccentric bushings 22*a* are typically employed in embodiments of the present invention having a secondary journal 16 located between two primary journals 14, and in more detail when the secondary journal has a smaller diameter than the two outer primary journals.

Referring now to FIGS. 1, 2 and 3, a subset of eccentric bushings 22 are assembled eccentric bushings having separable halves 22*a*. Assembled eccentric bushings 22*a* have separable bushing halves for assembly of eccentric bushings 22, on secondary journals 16. Eccentric bushings 22*a* preferably include alignment means for alignment of separable eccentric bushing halves, including upper bushing half 28 and lower bushing half 30, in second journal sockets 10, and also to hold the bearing halves together during assembly. The eccentric bushing 22*a* alignment means is preferably selected from the group consisting of bushing alignment pins 32; threaded fasteners; fractured surface alignment; adhesive; solder; brazing; welding or other functional means. Alignment pins 32 can be seen in FIGS. 1 and 10.

Referring now to FIGS. 3, 4, 7, 8 and 9 a subset of hinge pins 12 are assembled hinge pins 12*b*. A subset of primary journals 14 are primary journal eccentrics 14*b*. A subset of eccentric bushings 22 are full-round or contiguous metal structure eccentric bushings 22*b*.

Figure 7:
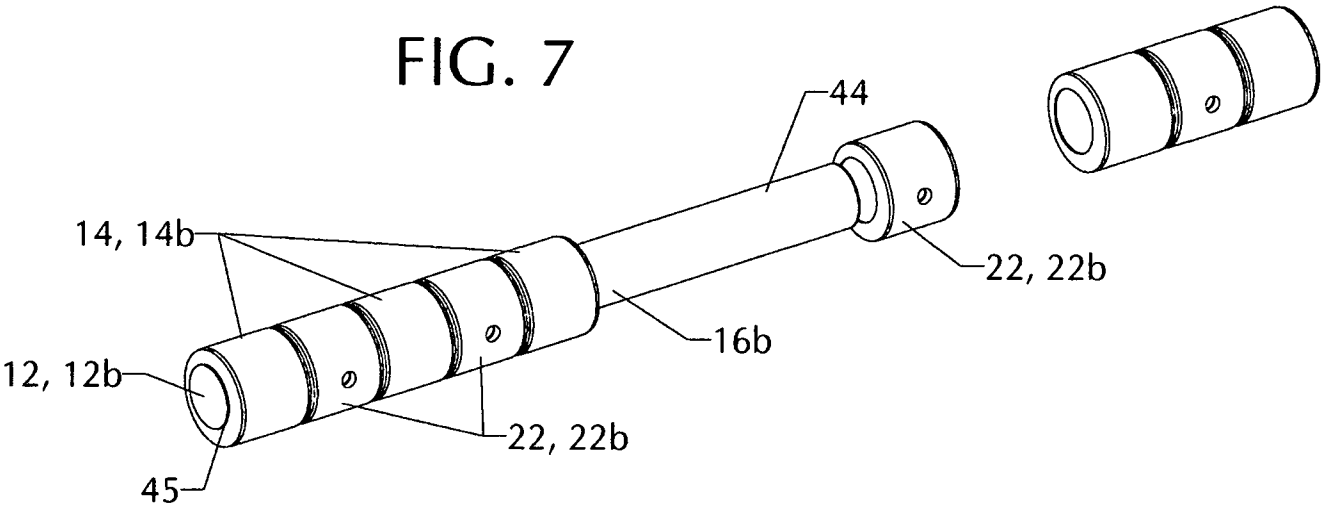
FIG. 7 is intended to illustrate a partially assembled hinge pin.
Figure 8:
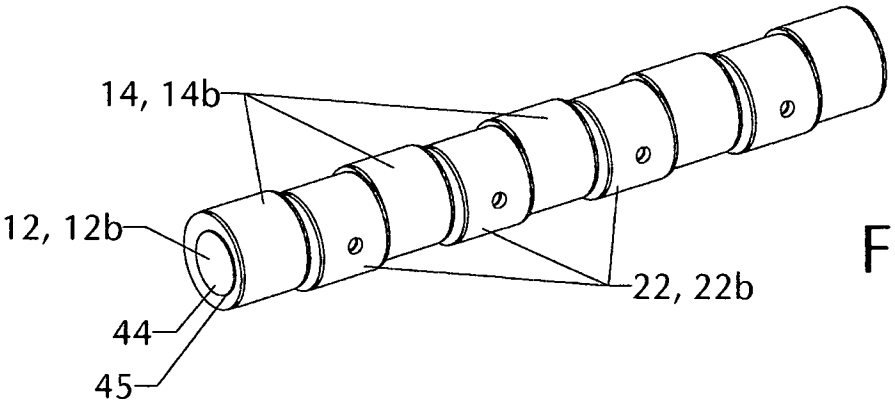
FIG. 8 is intended to illustrate an assembled hinge pin.

Assembled hinge pin 12*b* has a central shaft 44 and at least one primary journal eccentric 14*b* rigidly assembled onto central shaft 44. Hinge pin 12*b* further includes retaining means 45 for rigidly retaining primary journal eccentric 14*b* on central shaft 44. Preferably the retaining means 45 is selected from a group consisting of an interference fit; a key; a pin; a threaded fastener; adhesive; solder; braze; weld, or other functional means. FIGS. 7 and 8 are intended to illustrate primary retaining means 45, and in more detail where primary journal eccentrics 14*b* are press fit or shrink fit onto central shaft 44, or retained in place with an adhesive, solder, braze or weld. FIG. 4 is intended to illustrate primary journal eccentric 14*b*. Primary journal eccentric 14*b* has a full-round or contiguous metal structure.

Eccentric bushing 22*b* has a slip fit assembly onto central shaft 44. Central shaft 44 has a secondary journal surface 16*b* for supporting eccentric bushings 22*b*. FIG. 3 is intended to illustrate an eccentric bushing 22*b* having a contiguous metal structure. Bushing inner bearing surface 40 bears on secondary journal surface 16*b* on central shaft 44.

FIG. 7 shows a partially assembled hinge pin 12*b*, and FIG. 8 shows an assembled or largely assembled hinge pin 12*b*. FIGS. 7 and 8 show eccentric bushing 22*b* having a slip fit assembly onto said central shaft 44 between two primary journals eccentrics 14*b*, primary journal eccentrics 14*b* being rigidly assembled onto central shaft 44. FIG. 8 shows central shaft 44 and rigidly attached primary journal eccentrics 14*b* rotated relative to eccentric bushings 22*b* causing the outer diameters of the eccentric bushings 22*b* to fall out of alignment with the primary journal eccentrics 14*b*, as needed for adjusting the compression ratio of variable compression ratio engine 1.

Figure 9:
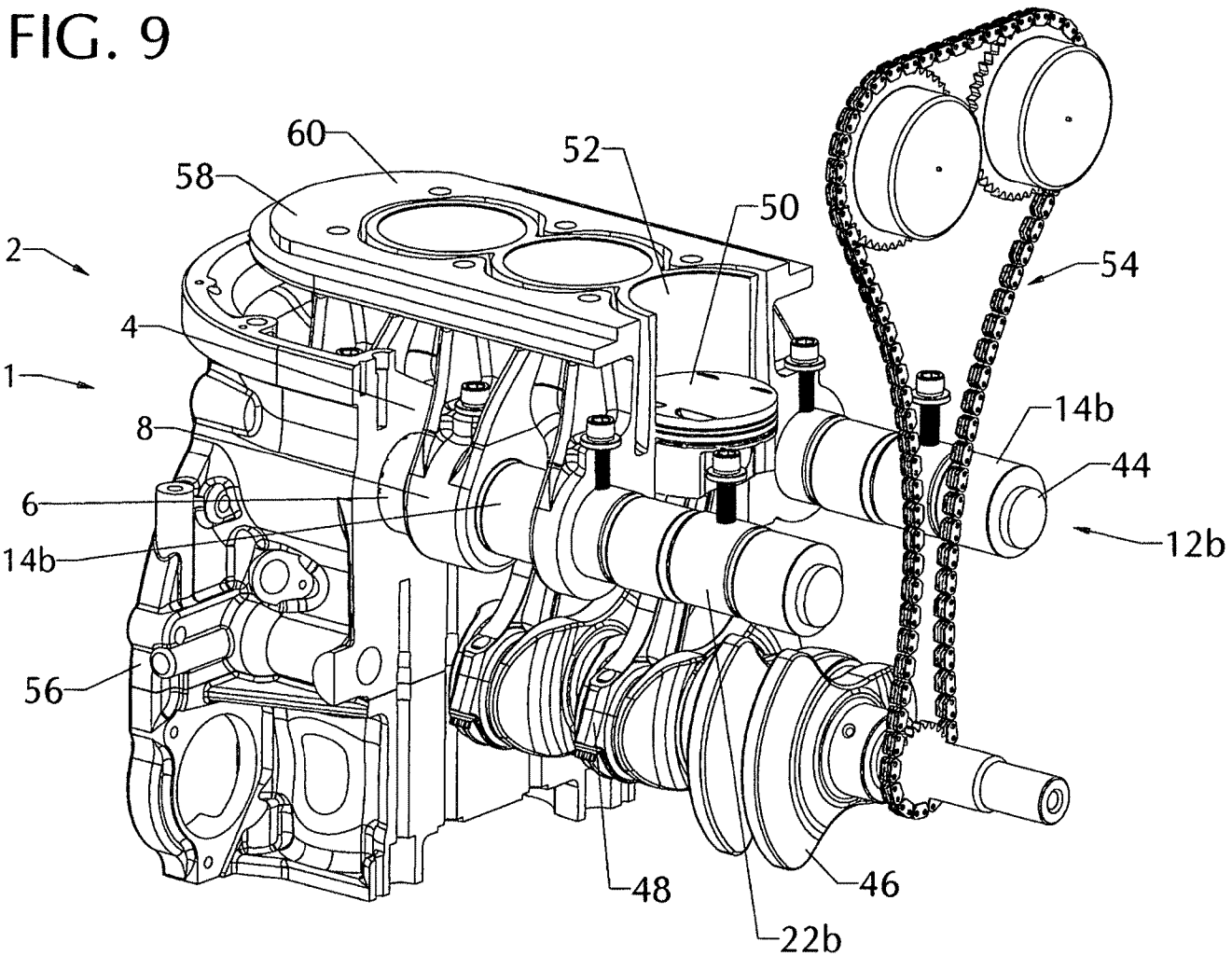
FIG. 9 is intended to illustrate a variable compression ratio engine having assembled hinge pins.

FIG. 9 is intended to illustrate a variable compression ratio engine having assembled hinge pins 12*b* according to the present invention. Variable compression ratio engine 1 has a crankshaft 46, a connecting rod 48 a piston 50, a cylinder 52, a camshaft drive chain 54, a crankcase 56, a cylinder jug 58 and a deck 60 for receiving a head gasket and cylinder head.

Figure 10:
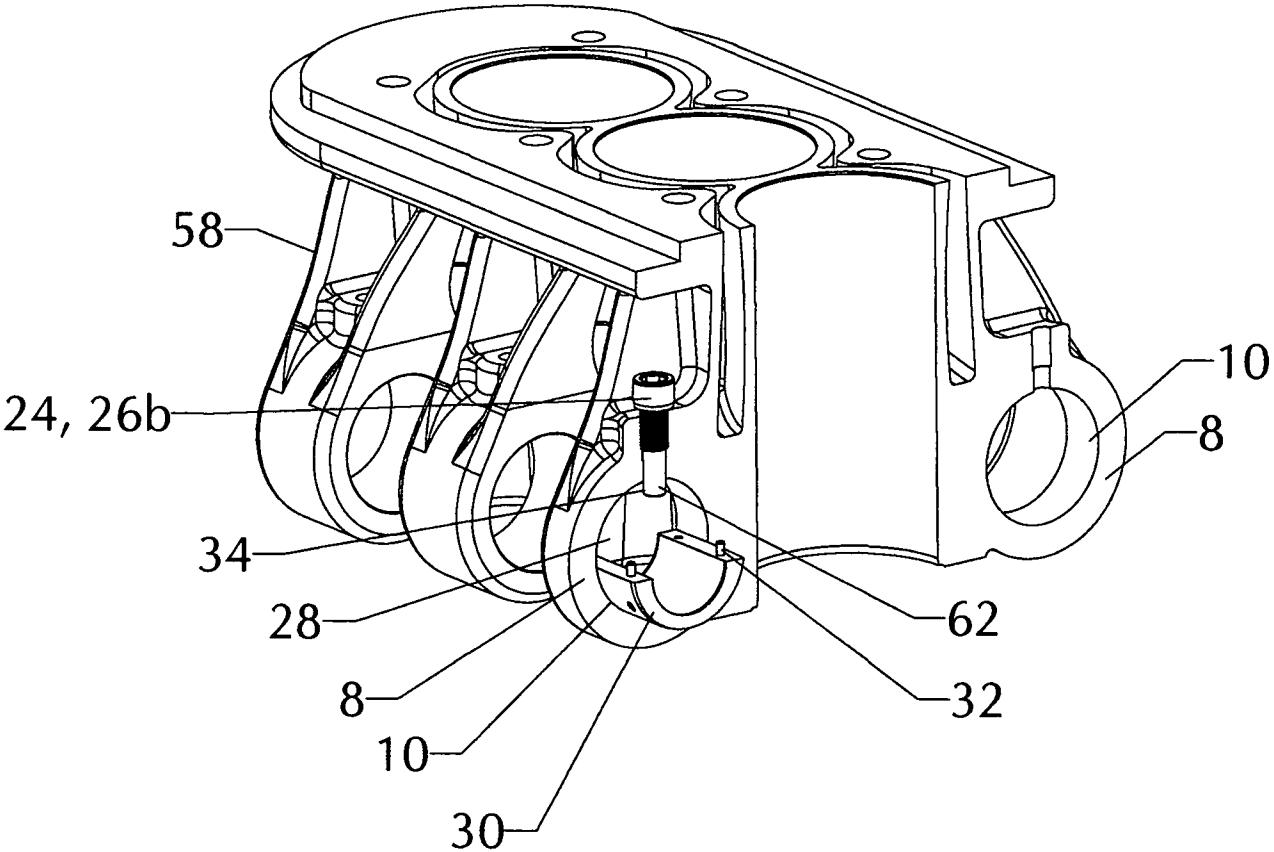
FIG. 10 is a detailed view of a compression fastener.

Referring now to FIG. 10, a subset of bushing retaining means 24 are compression fasteners 26*b*. Compression fasteners 26*b* are threaded into secondary bearing housing 8, and include a compression pin tip 62 for bearing down in socket 34. Alignment of eccentric bushing 22 is provided by pin tip 62 registering in the mating hole of socket 34. Compression fastener 26*b* bears down on upper bushing half 28, and upper bushing half 28 in turn bears down on lower bushing half 30, forcing lower bushing half 30 to be firmly seated in secondary journal socket 10.

According to an embodiment of the present invention, eccentric bushings 22 are mounted in first bearing housing 4, and primary journal bearings 6 are mounted in second bearing housing 8, and secondary journals 16 are repositioned to align with eccentric bushings 22, and primary journals 14 are repositioned to align with journal bearings 6, and retaining means 24 is repositioned to align with eccentric bushings 22.

The present invention is intended for use in variable compression ratio engines, but may also be used for other purposes where an expandable joint is needed.

The invention claimed is:

1. An eccentric hinged joint (2) having a first bearing housing (4) having a plurality of primary journal bearings (6), and a second bearing housing (8) having a plurality of secondary journal sockets (10), and a hinge pin (12) having a plurality of primary journals (14) and a plurality of secondary journals (16), said plurality of primary journals (14) defining a first journal axis (18) and said secondary journals (16) defining a second journal axis (20), said second journal axis (20) being offset from said first journal axis (18), wherein said eccentric hinged joint (2) further includes one or more eccentric bushings (22), said one or more eccentric bushings (22) being located in said second secondary journal sockets (10), said plurality of primary journals (14) being rotatably mounted in said primary journal bearings (6), and said secondary journals (16) being rotatably mounted in said one or more eccentric bushings (22) for providing eccentric motion of the eccentric hinged joint (2).

2. The eccentric hinged joint of claim 1, further including eccentric bushing retaining means (24) for preventing movement of said one or more eccentric bushings (22) in said secondary journal sockets (10), thereby securing the offset location of the eccentric bushing (22) in the secondary journal sockets (10).

3. The eccentric hinged joint of claim 2 wherein said eccentric bushing retaining means (24) is selected from the group consisting of a threaded fastener; a compression fastener; a pin; a key; adhesive; solder; braze; weld; and an interference fit (26).

4. The eccentric hinged joint of claim 2 wherein said eccentric bushing retaining means (24) is a compression fastener (26*b*), wherein said compression fastener (26*b*) includes a compression pin tip (62) for bearing down on eccentric bushing (22) and providing axial alignment of said one or more eccentric bushing (22).

5. The eccentric hinged joint of claim 1, wherein at least one of said eccentric bushings (22) is assembled onto said hinge pin (12) between two of said plurality of primary journals (14).

6. The eccentric hinged joint of claim 5, further having a first axial assembly clearance for slidably assembling said first eccentric bushing (22) on said hinge pin (12) through at least one primary journal bearing (6).

7. The eccentric hinged joint of claim 5, further having a second axial assembly clearance for slidably assembling said plurality of primary journal (14) on said hinge pin (12) through at least one secondary journal socket (10).

8. The eccentric hinged joint of claim 5, further having a first axial assembly clearance for slidably assembling said first eccentric bushing (22) on said hinge pin (12) through at least one primary journal bearing (6), and further having a second axial assembly clearance for slidably assembling said plurality of primary journal (14) on said hinge pin (12) through at least one secondary journal socket (10).

9. The eccentric hinged joint of claim 1, wherein said one or more eccentric bushing (22) has an outer bushing diameter and said plurality of primary journal (14) has an outer primary journal diameter, wherein said outer bushing diameter is within 0.007 inches of said outer primary journal diameter thereby enabling hinge pin (12) to slide into hinged joint (2).

10. The eccentric hinged joint of claim 1, wherein at least one primary bearing housing (4) has a contiguous material structure surrounding at least one primary journal bearing (6) thereby providing a rigid and compact eccentric hinged joint.

11. The eccentric hinged joint of claim 1, wherein at least one secondary bearing housing (8) has a contiguous material structure surrounding at least one secondary journal socket (10) thereby providing a rigid and compact eccentric hinged joint.

12. The eccentric hinged joint of claim 1, wherein at least one primary bearing housing (4) has a contiguous material structure surrounding at least one primary journal bearing (6), and at least one secondary bearing housing (8) has a contiguous material structure surrounding at least one secondary journal socket (10) thereby providing a rigid and compact eccentric hinged joint.

13. The eccentric hinged joint of claim 1, wherein said eccentric bushings (22, 22*a*) include separable bushing halves for assembly of said eccentric bushings (22, 22*a*) on said secondary journals (16).

14. The eccentric hinged joint of claim 13, further including alignment means (32) for alignment of said separable bushing halves.

15. The eccentric hinged joint of claim 14, wherein said alignment means (32) is selected from the group consisting of alignment pins; threaded fasteners; fractured surface alignment; adhesive; solder; brazing; and welding.

16. The eccentric hinged joint of claim 13, wherein said hinge pin (12) is a contiguous metal shaft including at least one of said primary journal (14) on either side of one of said secondary journal (16).

17. The eccentric hinged joint of claim 1, wherein said hinge pin (12, 12*b*) has a central shaft (44), wherein at least one primary journal eccentric (14*b*) is rigidly assembled onto said central shaft (44).

18. The eccentric hinged joint of claim 17, further including retaining means (45) for rigidly retaining said primary journal eccentric (14*b*) on said central shaft (44).

19. The eccentric hinged joint of claim 18, wherein said retaining means (45) is selected from a group consisting of an interference fit; a key; a pin; a threaded fastener; adhesive; solder; braze; and weld.

20. The eccentric hinged joint of claim 17, wherein said eccentric bushing (22, 22*b*) has a contiguous metal structure.

21. The eccentric hinged joint of claim 17, wherein said eccentric bushing (22, 22*b*) has a slip fit assembly onto said central shaft (44).

22. The eccentric hinged joint of claim 17, wherein said eccentric bushing (22, 22*b*) has a slip fit assembly onto said central shaft (44) between two primary journal eccentrics (14*b*) rigidly assembled onto said primary shaft (44).

* * * * *